US005795198A

United States Patent [19]

Pedone

[11] Patent Number: 5,795,198

[45] Date of Patent: Aug. 18, 1998

[54] FLOATING SEAL FOR HIGH ROTATIONAL SPEED PROPELLER SHAFTS WITH INTEGRATED FORCED OIL CIRCULATION GENERATOR AND SAFETY DEVICES

[76] Inventor: Antonio Pedone, Boulevard Albert-I, Monaco MC, Monaco

[21] Appl. No.: 776,741

[22] PCT Filed: Aug. 9, 1995

[86] PCT No.: PCT/MC95/00001

§ 371 Date: Feb. 3, 1997

§ 102(e) Date: Feb. 3, 1997

[87] PCT Pub. No.: WO96/05100

PCT Pub. Date: Feb. 22, 1996

[30] Foreign Application Priority Data

Aug. 10, 1994 [MC] Monaco ..... 2276
May 8, 1995 [MC] Monaco ..... 219/2276

[51] Int. Cl.[6] ..... B63H 23/36

[52] U.S. Cl. ..... 440/2; 440/83; 440/112

[58] Field of Search ..... 440/2, 83, 112, 440/277; 277/15, 59, 135

[56] References Cited

U.S. PATENT DOCUMENTS 3,565,447 2/1971 Goetze et al. ..... 440/112
3,625,523 12/1971 Gardner et al. ..... 440/112
3,844,247 10/1974 Collis et al. ..... 440/2
4,174,672 11/1979 Cox ..... 277/59

FOREIGN PATENT DOCUMENTS 2251273 7/1992 United Kingdom .

*Primary Examiner*—Sherman Basinger
*Attorney, Agent, or Firm*—Panitch Schwarze Jacobs & Nadel, P.C.

[57] ABSTRACT

Briefly stated, the present invention comprises a seal joint for a propeller shaft passing through a boat hull. The seal includes a bronze support bushing that is fitted over the propeller shaft, first elastic rings cooperating with the support bushing, an elastic bellows surrounding the shaft downstream of the support bushing, and a lubricating oil circulation system. The lubricating oil circulation system comprises two stages that cooperate to establish water tightness, a first ring-shaped water retention chamber filled with a viscous insoluble sealing medium, and a second chamber filled with lubricating oil. Forced, closed-circuit, circulation of the lubricating oil is produced during rotation of the propeller shaft within the support bushing, inside a static eccentric chamber formed within the support bushing, the support bushing being loosely fit onto the propeller shaft with no rigid fixing so that the propelled shaft is rotatable and axially moveable.

16 Claims, 5 Drawing Sheets

20
36
40
9
11
2
38

39

A-A
34
2
13
32
35
9
29

6
5
13b
14
32
9
13
29
35
11
10
34

B-B
32
35
11
9

FLOATING SEAL FOR HIGH ROTATIONAL SPEED PROPELLER SHAFTS WITH INTEGRATED FORCED OIL CIRCULATION GENERATOR AND SAFETY DEVICES

BACKGROUND OF THE INVENTION

On the leisure boats with inboard engine and shafting line, stuffing boxes are usually employed to prevent water from entering through the interstice between the outstanding propeller shaft and the hull opening, said stuffing boxes comprising one or more ring-shaped packings made of graphite-asbestos and being contained in a body that is concentrical with and pressed against the rotating propeller shaft.

In order to reduce the overheating caused by the friction between the packing and the rotating propeller shaft, and to allow the packing to be cooled, a certain amount of water ought to flow between these two members. This water penetrating into the hull is then to be drained away.

Another drawback of the stuffing box appears upon terminating navigation: the packing must be tightened very firmly in order to prevent it from continuously dripping, otherwise—in case of a prolonged stop—the boat would become filled with water, with the obvious consequences.

A further very important problem is the power consumption as a consequence of the rubbing between the packing and the propeller shaft: the bigger models have a cooling system. The friction thus caused produces an axle braking action that takes up a large amount of driving power, thereby increasing fuel consumption and causing a loss of speed. Differently said, it would be like driving a car with the hand-brake applied.

The rubbing between the packing and the propeller shaft causes moreover a premature wear of the shaft which, after a certain time length, is to be substituted.

Furthermore it is to be noted that mounting the stuffing box requires a perfect aligning of the propeller shaft along the outer propeller mounting bracket, the engine and the stuffing box; this gives rise to high assembly expenses.

Moreover, the stuffing box, being rigidly mounted on the hull, transmits all the vibrations of the propeller shaft to the same hull.

For a good operation quality, the three supports of the propeller shaft, i.e. the engine coupling, the stuffing box and the propeller mounting bracket are to be perfectly aligned.

Since such a structure is not a single block that is machined in one run to form a single length, a perfect aligning is almost impossible to be achieved; consequently, the transmission shaft never works in the optimum condition, whereby it exhibits a great rotational resistance, said resistance being due not only to the braking action of the packing, but also to the forcing of the transmission as a consequence of the impossibility to achieve a perfect alignment.

Another sealing device that is often used on certain boats consists of a rotating joint comprising a disk that rotates with the shaft, said disk being pushed by a spring against another disk that is coated with a friction-reducing material (graphite and alike), this latter disk being fixed to the hull.

The most serious problem is that all types of rotating joint—with rings integrally fixed to the axle, such as the one known from GB-A-2251273 having the features according to the preamble part of claim 1—do not allow the shaft to axially slip, with the consequence that in case of a commonplace (and rather frequent) accident like a line winding on the propeller that pulls rearwards the propeller shaft which in turn is fixedly connected to the engine, one or more engine mountings can be broken and the engine displaced rearwards. This causes the rotating joint to be broken with the consequent opening of a large water flow passage and creates a shipwreck risk.

Further problems associated with such a rotating joint consist in the friction races being degraded—also by action of the sodium chloride crystals—with the consequent leakage of water into the hull, both when the shaft is rotating and when it is at rest.

A problem shared by all the stuffing boxes and rotating joints is that they cannot be operated without water (for example in the case of a high speed forming a water pocket in front of the propeller, or in case of an obstructed sea—water intake, and so on) because they would be subject to quick failure.

A second common problem is the water leakage, which is more or less pronounced according to the kind: the stuffing box clearly allows water to leak; the rotating joint is leakproof when it is new, but after the least degradation of the friction race water can leak both when the shaft is rotating, and when it is at rest.

BRIEF SUMMARY OF THE INVENTION

Briefly stated, the present invention comprises a seal joint for a propeller shaft passing through a boat hull. The seal includes a bronze support bushing that is fitted over the propeller shaft, first elastic rings cooperating with the support bushing, an elastic bellows surrounding the shaft downstream of the support bushing, and a lubricating oil circulation system. The lubricating oil circulation system comprises two stages that cooperate to establish water tightness, a first ring-shaped water retention chamber filled with a viscous insoluble sealing medium, and a second chamber filled with lubricating oil. Forced, closed-circuit, circulation of the lubricating oil is produced during rotation of the propeller shaft within the support bushing, inside a static eccentric chamber formed within the support bushing, the support bushing being loosely fit onto the propeller shaft with no rigid fixing so that the propelled shaft is rotatable and axially moveable.

All of these, and other drawbacks, are solved by the present invention that will be described hereinafter with reference to the attached drawing in which:

DETAILED DESCRIPTION OF THE INVENTION

The present invention consists of a two-stage positive sealing device: it allows no water leakage independently of whether the propeller shaft is rotating or idle. The two stages, that follow one another, form two weirs water cannot pass.

It consists of a cylindrical casing that is freely fitted over the propeller shaft and tightly seals the hull aperture by means of an elastic bellows-shaped pipe length which is secured to the outer part of said casing and to the hull aperture; inside, in correspondence with the shaft, it frontally has a ring-shaped stop chamber that is filled with a sealing material consisting of a viscous insoluble grease that prevents water from passing through the interstice between the shaft and the bush without causing rubbing or mechanical wear. The second stage consists of the oil chamber enclosing the bronze bushing.

Figures 1, 1A:
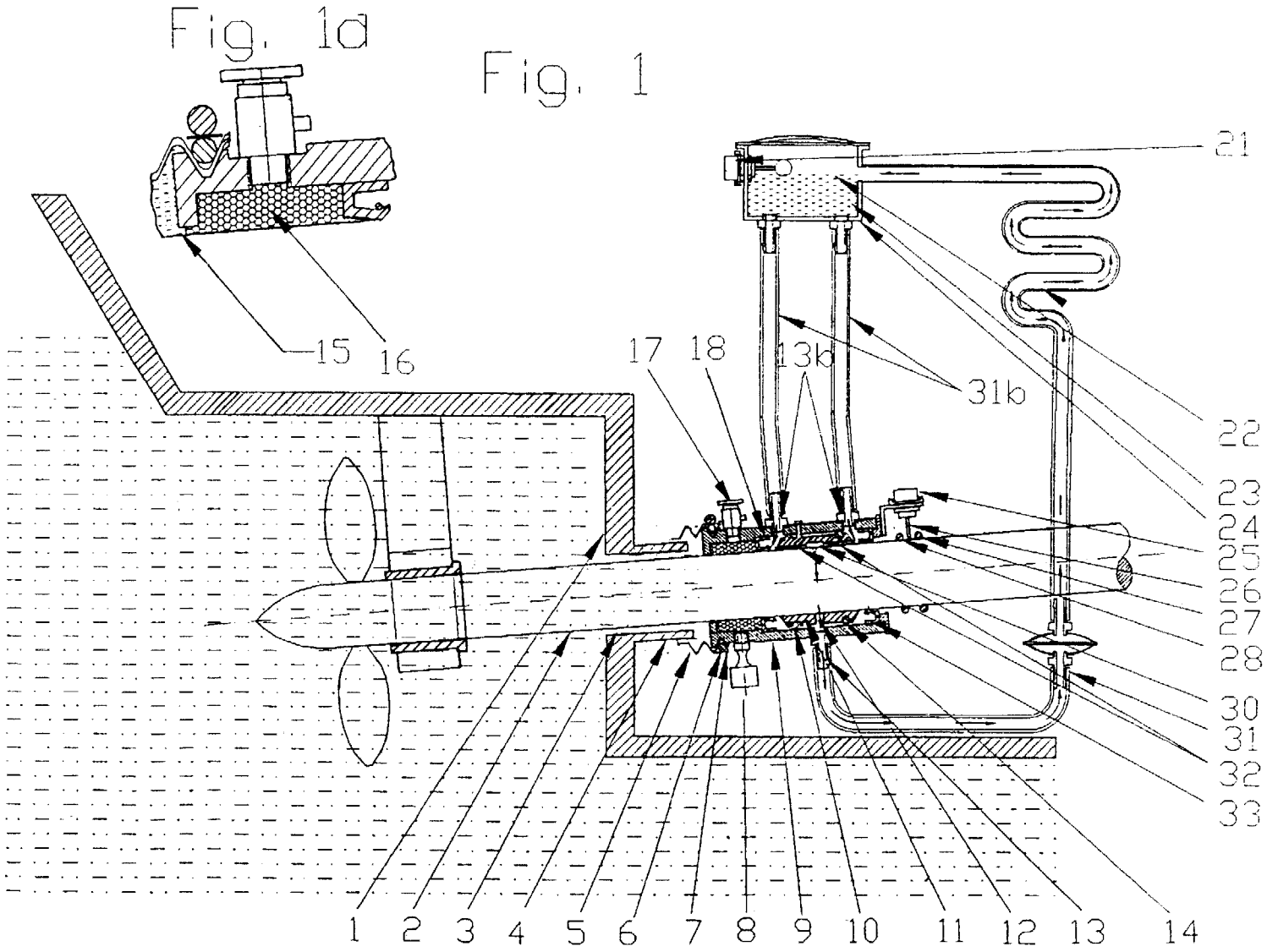
FIG. 1 is a general longitudinal section view illustrating a propeller shaft protruding from the hull of a boat. On said shaft the object of the invention is shown in a sectional view.
FIG. 1*a* is an enlarged view of the water retention chamber.

FIG. 1 is a longitudinal view schematically showing a standard boat with a transmission shaft 2 crossing hull 1 through aperture 3 encircled by the tube length 4 that is integral with the hull.

The bronze bushing 11 (arranged inside the cylindrical casing 9) is freely fitted on propeller shaft 2, thereby allowing it to both freely rotate and slide in the axial direction without opposing resistance as a consequence of misalignment that would impose strain and increase friction.

It is well known that transmissions realized with bronze bushings are very difficult to implement because the bushing surfaces are to be perfectly aligned and very carefully machined, owing to the fact that even a slight misalignment gives rise to a remarkable rotational resistance. For this reason, bronze bushings cannot be used in transmissions on structures that are not very stiff and perfectly machined, but self-orienting bearings are normally used.

In the case of the present invention, in order to easily use the bronze bushing, the problem has been solved by means of the self alignment bearing on the same axle, with a suitable tolerance neither too large, nor too scarce—with no rigid fixing that would make rotation very difficult as just explained herein above. Thus, the bronze bushing of the present invention allows the shaft onto which it is mounted to freely rotate without causing any resistance to the radial or the axial motion, also owing to the force feed lubrication system to be explained hereinafter.

On the bronze bushing 11, the cylindrical casing 9 is heavy-force fitted through first elastic O-rings 10 and 14.

Onto the cylindrical casing 9 an end of an elastic pipe length having an elastic bellows shape 5 is secured; the other end is secured to the tube length 4 encircling aperture 3 of the hull (through which the propeller shaft protrudes). Water penetrating through the hull aperture is therefore retained by the elastic, bellows-shaped tube length, by the shaft and by the ring-shaped stopping chamber 16 on cylindrical casing 9 that is filled with sealing material consisting of insoluble viscous grease.

The cylindrical casing 9 is arranged concentrically to the shaft and in its front part is provided with an aperture the diameter of which is scarcely larger than the shaft diameter, just enough not to rub against the shaft. Beyond the initial aperture, the inside diameter of the casing is enlarged, thereby forming the ring-shaped stopping chamber 16 that has its bottom part delimited by the retention ring 18.

The ring-shaped stopping chamber 16 is filled with the viscous sealing agent preferably consisting of insoluble grease that, having a lower specific gravity than water, is continuously kept under pressure by the static head, thus being caught against the walls of the ring-shaped stopping chamber 16, against the retention ring 18 and against shaft 2; thereby preventing any water leakage into the ring-shaped stopping chamber.

The viscous sealing medium is initially introduced into the stopping chamber through the Stauffer lubricator 8 that fills with grease the whole chamber 16, the air being vented through the vent valve 17.

The cylindrical casing 9 preferably consists of a thermally conducting, corrosion resistant metal (for example bronze or stainless steel). Said casing is supported internally by the bronze bushing 11, which is made of antifriction material, that is forcedly retained in a concentrical arrangement onto elastic rubber rings (O rings) 10 and 14.

The bronze bushing 11—that is lubricated by forceful oil circulation on the shaft—supports and guides the cylindrical casing 9 always keeping it in a concentrical and parallel arrangement relative to the shaft on which it is mounted, said shaft having the possibility to rotate freely owing to the lubrication provided by oil 23, that is contained in reservoir 24, through the supply pipes 31*b* that are fixed to the grooved nipples 13*b*, said nipples being screwed onto the cylindrical casing 9.

Between the bronze bushing 11 and the cylindrical casing 9 a crown shaped chamber 35 is formed (determined by the difference of respective diameters) that is contained by the rubber gaskets (O rings) 10 and 14 and that is filled with oil passing through hole 12 of the bronze bushing 11 thereby filling the ring-shaped channel 30, consequently consistently lubricating shaft 2, bronze bushing 11 and the elastic lips of the asymmetric-lip retention rings for rotating shafts 18 and 33 that contain the oil between the shaft portion and the cylindrical sleeve, at the same time being lubricated and preventing oil from escaping. Oil passes therefore through the grooved nipple 13 into the return tube 31 to be returned into reservoir 24.

The continuous forced circulation of oil, with the consequent turnover as is necessary for an optimum lubrication in the support and radial and axial sliding zone of the bronze bushing 11, is achieved by means of a built-in oil pump.

The continuous lubrication is very important and both the bronze bushing on the shaft and, especially, the elastic asymmetric-lip retention rings for rotating shafts should never be left without.

The oil reservoir 24 is located at a greater height than the water level so as to apply a greater pressure to the oil contained in the chamber of the bronze bushing 11 in order to contrast and stop the tendency to permeability of the sealing grease through the unidirectional retention ring 18.

The unidirectional retention ring 18 is thus lubricated internally by the oil it contains, whilst on the outer part is lubricated by the sealing grease. The service life of the clamping lip becomes therefore very long.

The asymmetric lip retention rings for rotating shaft with elastic lip made of elastomeric material are unidirectional. Thus they prevent any oil leakage in one direction, while allowing it to pass in the other direction. It is to be noted that for the asymmetric lip retention rings to properly work during a long service life span, a continuous lubrication of the clamping elastic lip is absolutely necessary. Should it occur that the oil lubrication be stopped even for a very short time, the lip, being in contact with water (or even worse dry), would be rapidly spoiled and could no longer assure a leakage-proof seal. It is therefore absolutely necessary to have an effective and continuous force feed oil lubrication not only for the bronze bushing 11, but also, and especially, for the unidirectional, asymmetric lip retention rings.

The oil reservoir 24 is located at a greater height then the level of the outer water owing to the specific gravity difference between oil and water. In this way the pressure exerted by water from outside onto the sealing medium is lower than the counter-pressure provided by the oil so as to prevent the sealing medium from leaking into the oil through the unidirectional retention ring 18, which might cause the lubricating properties of the oil to be changed. Thus there is no oil or grease consumption due to leakage to the outside, so that all environmental requirements are met.

The elastic tubular bellows-shaped tube length 5 is made of a very thin rubber, or other elastomeric material that is capable to withstand oils and sea water.

It is important that the bellows-shaped elastic tube length is very elastic in order to allow a maximum floatability. Thus, the present sealing joint can be mounted with no alignment between the shafting and the sleeve crossing the hull. The great elasticity allows it to work properly even on a twisted shaft—that rotates eccentrically—because the elasticity of the bellows-shaped elastic tube length 5 absorbs any faulty alignment or eccentricity of the propeller shaft.

In order to achieve such a great elasticity, it is necessary that the tubular bellows-shaped elastic tube length 5 has very thin walls. But this means that the bellows-shaped elastic tube length offers no torsion resistance warranty, with the consequence that any sudden increase of rubbing between the bronze bushing and the shaft (for example owing to an outer accident that might cause oil loss and seizing of the bronze brushing 11) might cause the thin rubber sheet of the bellows-shaped elastic tube length to be lacerated, thereby causing a very considerable amount of a water to enter, which would be very dangerous.

Figures 2, 2A:
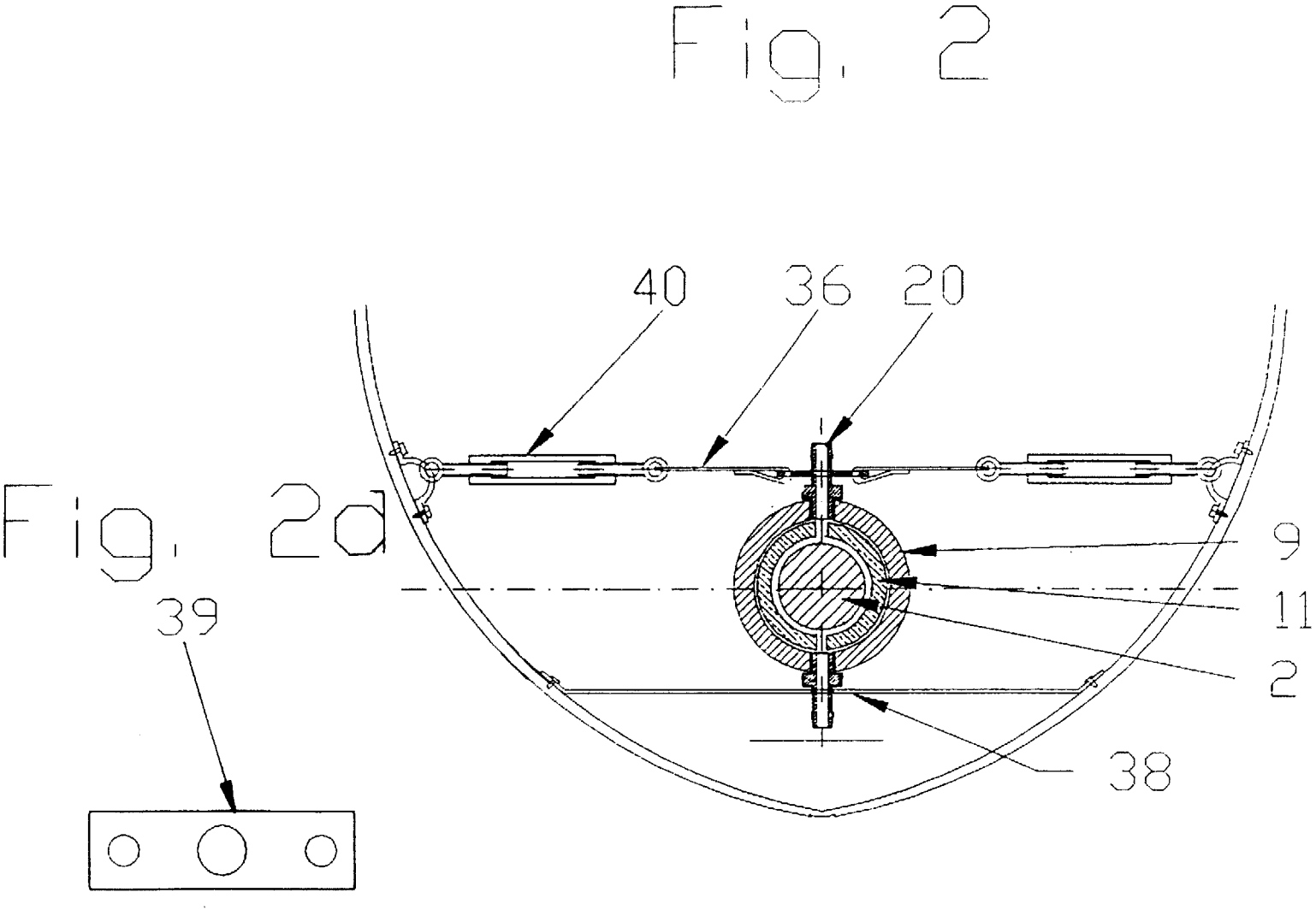
FIG. 2 is a cross section view illustrating the hull of a boat, the shaft and the sealing joint.
FIG. 2*a* is an enlarged view of the antirotation plate.

In order to eliminate such an—actually very unlikely—possibility, FIG. 2 shows a cross section view of the anti-rotation device consisting for example—of a small plate 39 that is loosely fitted onto the grooved nipple 20. To plate 39 two cables 36 are secured the ends of which are attached to two wire turnbuckles 40 that are fixed to the hull. The magnified detail of FIG. 2 shown in FIG. 2*a* illustrates a plant view of the plate having a central hole the diameter of which is slightly greater than that of the grooved nipple 20; the holes at the ends have the same diameter as cables 36.

By moderately tensioning the two cables, the grooved nipple 20 abuts against plate 39, thereby preventing the assembly from rotating and eliminating any torsional stress on the bellows-shaped elastic pipe length. This latter—not having to bear any stresses and only having the function of containing the water—can be made from a material having a very scarce thickness, thereby assuring the maximum elasticity and floatability of the system.

Another non limiting possible embodiment of a rotation preventing device is the draw length 38 secured to the hull with a hole blocked around grooved nipple 13 as an abutment.

A further safety device against a possible, though very unlikely, seizing consists of the bronze bushing 11 being simply pressed onto casing 9 by means of O rings 10 and 14. Thus, should the bronze bushing get seized as a consequence of a fortuitous accident thereby tending to rotate with the shaft, it would rotate on the O-rings 10 and 14. Casing 9 would thus not be caused to rotate since it would be blocked by the rotation preventing system, thereby keeping the bellows-shaped elastic pipe length 5 intact as it would not be torn, thus eliminating any risk of shipwreck.

A further safety device against excessive sliding of the propeller shaft 2 comprises a safety electrical switch 25 mounted on the upstream end of the cylindrical casing 9. The electrical switch 25 has a control arm 26, one end of which is connected to the electric switch 25 and the other end is arranged between two second elastic rings 27, 28 that are fitted onto the propeller shaft 2. Excessive axial motion of the propeller shaft 2 causes the control arm 26 to contact at least one of the second elastic rings 26, 27 thereby actuating the electric switch 25.

Since on the sea one can never take too many precautions, in order to eliminate any likelihood of accident a level sensor 21 can be introduced into the oil reservoir 24 (FIG. 1) which, should the oil level become too low, would first actuate a sound alarm and then stop the engine.

On very powerful boats with large shafts rotating at a high speed a forced oil circulation has been shown to be absolutely necessary because otherwise in the proximity of the elastomeric lips of the asymmetric-lip retention rings the oil would be degraded rather quickly as a consequence of the very high temperature, thereby losing its lubricating power, which would cause the elastomeric material to age early with a consequent oil leakage and a rapid wear of the shaft on which very deep grooves would form at the lips of the retaining rings.

Thus it has been ascertained that it is absolutely necessary to have a very effective forced circulation of the oil.

For this purpose, a bronze bushing 11 having a built-in oil pump has been realized, said pump using not only the rotational motion of the shaft it is built on, but using also the shaft itself as the basis member of this very original pump.

In this way—without having recourse to a separated oil pump, that would be more expensive and complex—the necessary forced circulation is obtained, said circulation being proportional to the various rotational speeds of the shaft and thus always proportional to the different lubrication and cooling needs, which increase as a function of the rotational speed.

Figure 3:
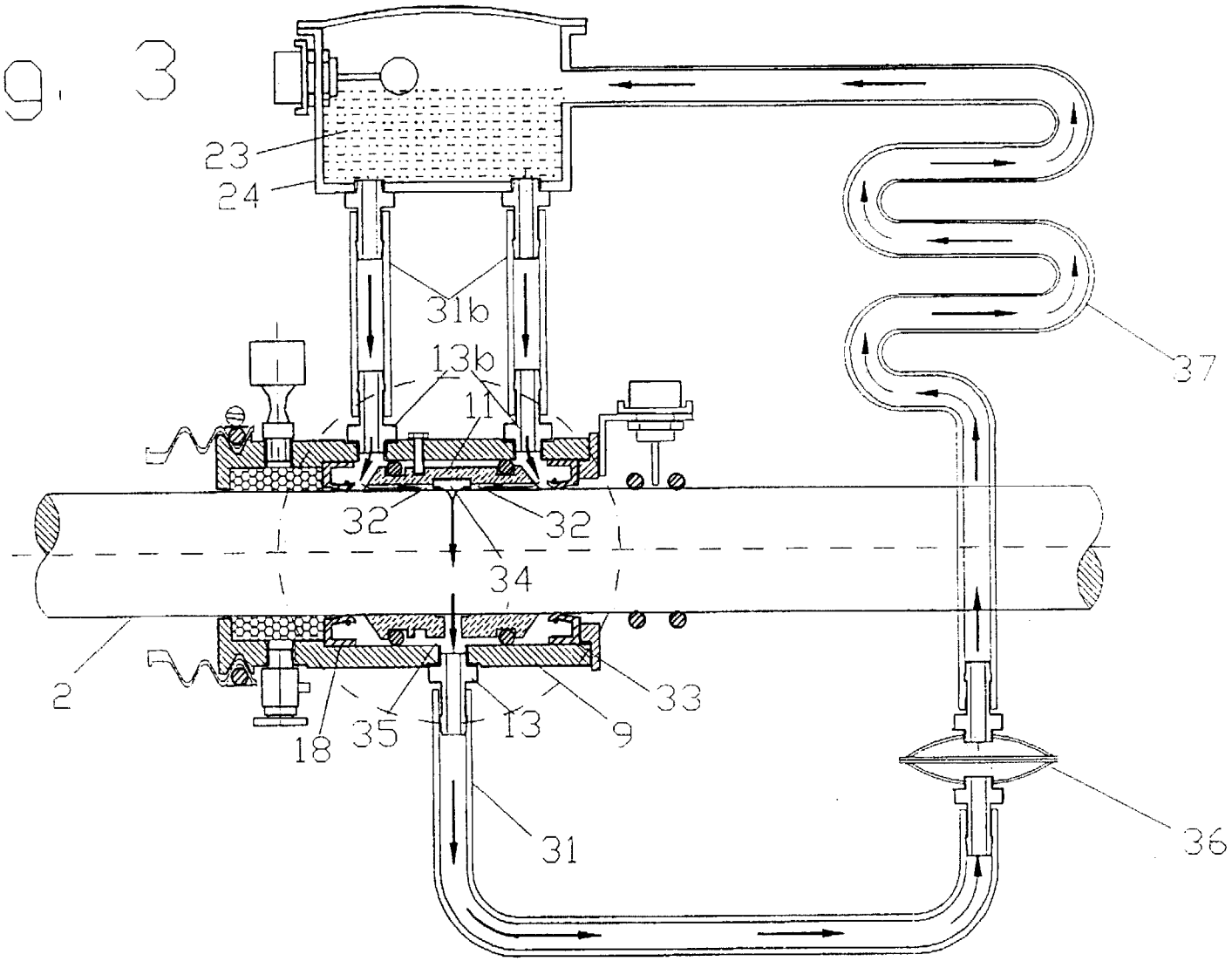
FIG. 3 is a general cross section view of the sealing joint.

FIG. 3 shows the oil reservoir 24 from which the two supply pipes 31*b* depart, said pipes being secured onto the grooved nipples 13*b*. These grooved nipples are screwed to the casing 9 and allow the oil to get in, whereby said oil, during its passage, lubricates the lips of the unidirectional asymmetric lip retention rings 18 and 33 made of an elastomeric material. The oil continues along its path and enters the tunnels 32 (see also FIG. 5) of the bronze bushing 11 where it consistently lubricates the shaft that rotates within the bronze bushing (see also FIGS. 4 and 5) by entering into the space between the shaft and the bronze bushing, thus forming a thin intermediate oil layer that separates the metals. This intermediate layer prevents the metals from rubbing with one another and protects them from wear.

Figures 4, 5, 6:
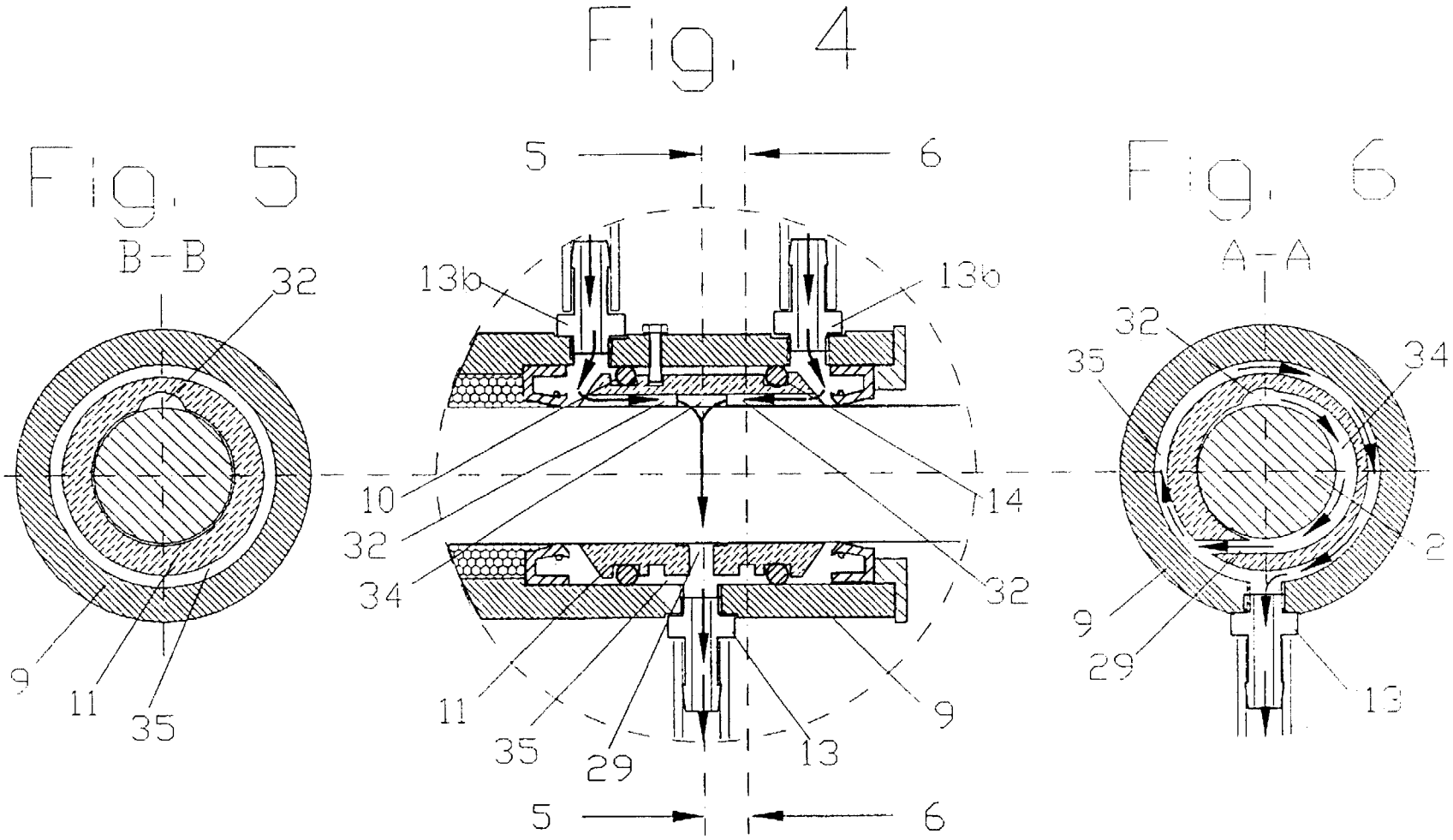
FIG. 4 is a detail view of FIG. 3 on a larger scale.
FIG. 5 is a cross section view of FIG. 4.
FIG. 6 is another cross section of FIG. 4.

At the centre of the bronze bushing 11, there is a cylindrical eccentric chamber 34 that is arranged eccentrically relative to the shafts 2 (see FIG. 6).

The oil is dragged by the shaft in its rotation owing to the "surface tension" and "glueing of a heavy viscous liquid to a solid (the shaft)" phenomena, and is compressed towards the narrowing part of the eccentric chamber. A small portion of the oil enters between the shaft and the bronze support bushing section the diameter of which almost closely fits that of the shaft, thereby forming an intermediate layer that assures lubrication and hinders the direct contact between the two metals, thereby protecting them from wear. At the same time, the excess oil that cannot enter between the shaft and the bronze bushing accumulates near the narrowing part, thereby causing the pressure to increase. In this region there is a—preferably tangential—slot (or outlet aperture) 29 that allows the oil under pressure to flow out, said oil entering the cylindrical crown-shaped chamber 35 (formed by the difference between the outer diameter of the bronze bushing 11 and the inner diameter of the cylindrical casing 9; and closed laterally by the two elastic O-rings 10 and 14). The oil pushed into chamber 35 rotates until it exits through the grooved nipple 13 connected to pipe 31. The oil, under the thrust produced by the pressure, passes a possibly provided oil filter 36 (FIG. 3) that always keeps it clean and removes possible lumps. The oil passes then the heat exchanger 37—formed by a thermally conducting metal coil—that cools it by causing the calories to flow to the environment air. The filtered and cooled oil finally returns to reservoir 24. The oil—air heat exchanger is employed in the case of rather high speed because in such a case the heat drained through the thermally conducting casing 9 is not enough.

This oil pumping system is very effective as it can be appreciated that pumping occurs also at very low speeds: even the circulation produced by manually turning the shaft is appreciable. Obviously the faster the shaft rotates, the greater is the amount of oil pumped. If it is desired to obtain a greater flow-rate, it is enough to proportionate the pump by making it wider in the bronze bushing it is built in.

This pumping system presents several advantages:

Cost-saving construction: a little more work-out during the manufacturing stage of the bronze bushing is enough to realize the pump without having to resort to separated pumps with drives also separated.

Always proportionate flow-rate and pressure as a function of the shaft rotation speed that increases or reduces the lubrication, cooling and filtration needs proportionately with the shaft rotational speed.

No transmission or other separated motors for driving the lubrication pump, the propeller shaft itself onto which it is mounted being used.

The perfect lubrication ensures a good continuous working of the pump and of the whole sealing joint assembly, thereby warranting an almost endless service life because the consistent presence of the oil layer between the shaft and the bronze bushing prevents both of them from being worn, thus giving rise to an extremely long service life. The same can be said about the unidirectional elastic asymmetric lip retention rings made of an elastomeric material.

The oil is not altered and always maintains its lubricating power because it is continuously filtered and never overheated. Accordingly, the sealing joint always operates in its optimum condition, thus positively preventing the water from entering the boat through the sealing joint.

It is to be noted that when a boat navigates at a very high speed a water void is formed in correspondence with the exit point of the propeller shaft from the hull, which is a serious problem for the conventional stuffing boxes where the lubrication and the cooling provided by the water is thus lacking. On the contrary, in the present invention, with this system for the forced circulation and for the cooling of the oil, it has been ascertained that this problem does not exist: the sealing joint can operate perfectly also in the absolute absence of the water even at a very high speed and for thousands of hours without interruption.

Figure 7:
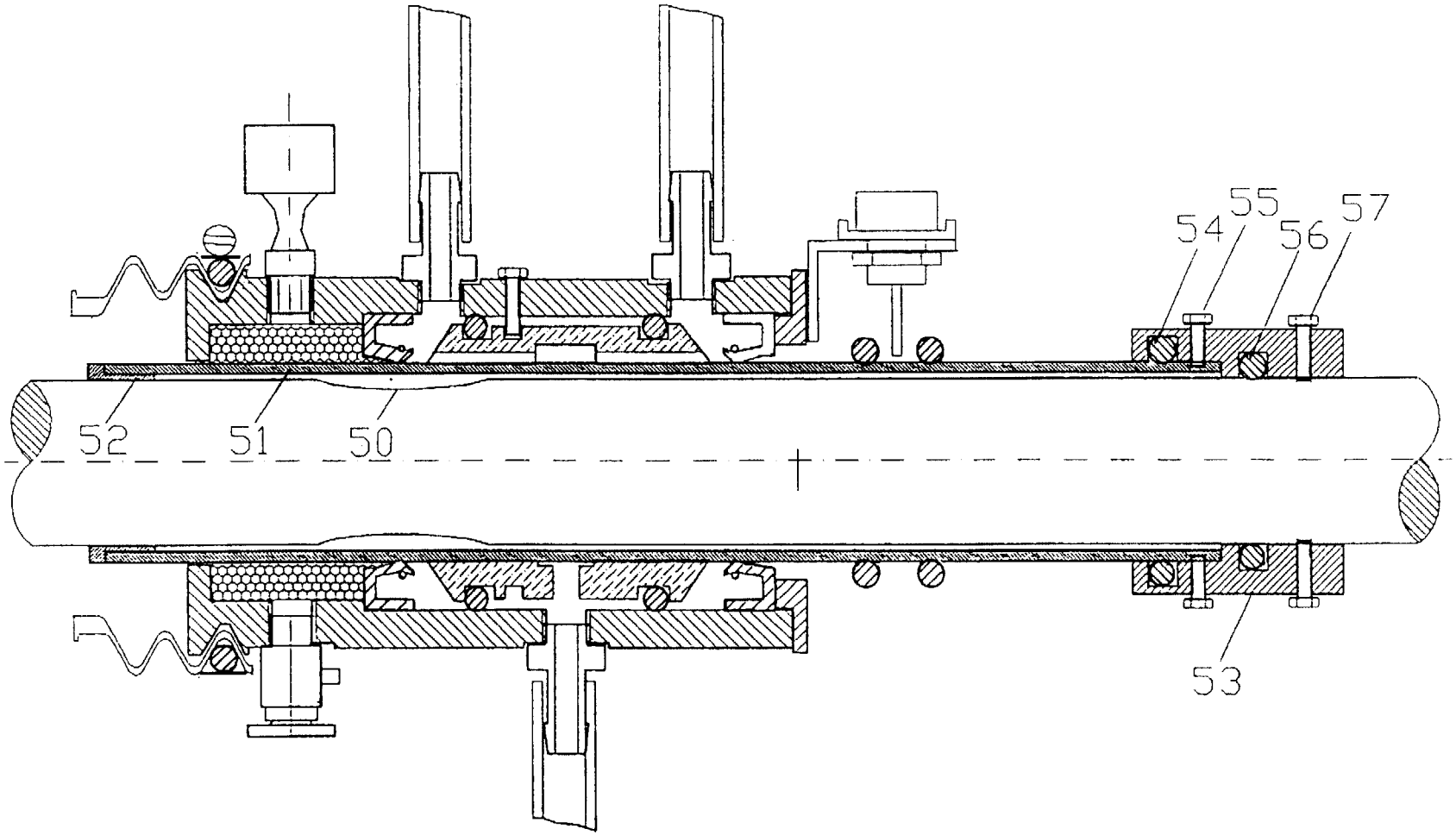
FIG. 7 is a longitudinal section view of the device with an optional addition.

FIG. 7 shows the application example of the sealing joint on a shaft of an old boat. The shaft exhibits wear 50 caused by a rubbing packing of a conventional stuffing box. In correspondence with it, a rigid tube length 51 is mounted having an inner diameter that is slightly larger than that of the shaft. At the end towards outside, the tube length is supported concentrically with the shaft by bush 52. At the inner end, the tube length is clamped by bush 53 that is blocked by screw 55. The bush is locked to the shaft by means of the screw 57, and accordingly the tube length rotates with the shaft. The third elastic O-Rings 54 and 56 prevent water from entering through the bush 52 between the shaft and the inside of the tube length 51. On said tube length concentrically secured to the propeller shaft, the sealing joint can thus been mounted in a standard way, as described above.

In this way, old used shafts can be recovered without being forced to substitute them.

In short, the results achieved by the present invention are:

a) Absolute water tightness owing to the two stages forming two weirs water cannot pass, said two stages being arranged after one another and consisting the first one of the grease chamber compressed by the static head and the second one of the counter pressure oil chamber in which the bronze bushing is housed.

b) Water tightness positively maintained in time because after several thousands hours of operation should the retention rings become worn nothing more than a little oil leakage inside the boat can occur—said oil being recoverable—but water would never enter. It will be then possible to restore the oil level, possibly using the recovered oil, and simply plan the substitution of the elastic lip retention links.

c) Very low friction coefficient owing to:
   - perfect continuously fed forced lubrication of the bronze bushing
   - perfect continuously fed forced lubrication of the retention rings lips
   - floating seal joint consistently self aligned with the shaft because it is simply fit onto the shaft, kept in place by the rotation preventing device, free of any rigid fixing.

d) Owing to the extremely low friction coefficient thus obtained, any braking effect is avoided, and there is no waste of driving power: lower operating costs and higher boat speed there result.

e) The forced oil circulation system is simple, reliable, cost-saving and wear-resistant.

f) Lubrication and cooling are achieved without water, thus making the present invention positively necessary on high speed boats, where water void forms.

g) Owing to the continuously forced lubrication system, to the concept of rigid fixing-free mounting that applies no strain to the shaft, and to the extremely low friction coefficient, the shaft undergoes no wear in time, thus preventing deep grooves from forming. In fact, the possibility of a continuous axial sliding on the shaft, with a small displacement that is equivalent to the slight play of hole 38 or 39 on projection 20 (see FIG. 2) of the rotation preventing device, said displacement being caused by the imperceptible to and fro motion resulting from the vibrations of the engine (that is normally secured on vulcanized rubber elastic mountings), provides for the elastic lips of the retention rings 18 and 33 always to rotate on a consistently lubricated surface, as the bronze bushing does. This also contributes to prevent any grooves from forming on the shaft surface.

h) The construction system aiming at not using any disk or ring fixed to the shaft in order to assure the possibility of shaft sliding, this being combined with the catch device in case of abnormal shaft displacement, prevents possible accidents. (The rotating joints that are available on the market have not been successful because they do not offer the warranty of a possible axial displacement of the shaft).

i) The rotation preventing system, besides being a safety device against possible accidents, allows the maximum flotability; thus it can be operated even on twisted, misaligned shaft, and even when they are not concentrical with the exit hole on the hull.

j) The optional rigid tube allows used, damaged shafts to be utilized.

k) The heavy-force-fit casing on the support bronze bushing between the two elastic O-rings warranting the maximum security, even in the extremely rare case of a strange accident that might for example break the oil pipes and cause the bronze bushing to seize. Even in such a rare case, the seal joint would temporarily go on working until it can be repaired.

I claim:

1. A seal joint for a propeller shaft passing through a boat hull, comprising a bronze support bushing (11) that is fitted over the propeller shaft (2), first elastic rings (10, 14) cooperating with said support bushing, an elastic bellows (5) surrounding said shaft downstream of said support bushing (11), and a lubricating oil circulation system, the lubricating oil circulation system comprising two stages that cooperate to establish water tightness, a first ring-shaped water retention chamber (16) filled with a viscous insoluble sealing medium, and a second chamber (32, 34, 35) filled with lubricating oil (23), the lubricating oil circulation system employing (23) closed-circuit forced circulation produced during rotation of said propeller shaft (2) within said support bushing (11), inside a static eccentric chamber (34) formed within the support bushing, said support bushing being loosely fit onto the propeller shaft with no rigid fixing whereby the propeller shaft is rotatable and axially moveable.

2. The seal joint according to claim 1, wherein said eccentric chamber (34), communicates with a cylindrical crown-shaped chamber (35) between the support bushing (11) and a cylindrical casing (9) that surrounds said support bushing (11), the two chambers being traversed by the flow of said lubricating oil (23) that is forced by the rotation of the propeller shaft (2).

3. The seal joint according to claim 2, wherein the cylindrical casing (9) is provided with a rotation preventing device comprising a projection (20) surrounded by an abutment (38, 39) fixed to the boat hull.

4. The seal joint according to claim 3, wherein the seal joint comprises a rigid tube (51) the length of which is sufficient to be arranged over a damaged part (50) of a used propeller shaft of an older boat, said rigid tube length being fitted and kept concentrical with the propeller shaft by bushes (52, 53) in which third elastic rings (O-rings 54, 56) are provided to prevent water leakage.

5. The seal joint according to claim 2, wherein the seal joint comprises a reservoir (24) for the lubricating oil (23), said reservoir (24) being located at a greater height than the water level of the boat hull so as to fill with oil said second chamber (32, 34, 35) through supply pipes (31*b*) that are fixed by grooved nipples (13*b*) to the cylindrical casing (9) and through a ring-shaped channel (30), a grooved nipple (13) communicating with said crown-shaped chamber (35) being provided for the outlet of oil (23) back to the reservoir (24) through a return pipe (31).

6. The seal joint according to claim 5, wherein on said return pipe (31) there are provided, upstream of said reservoir (24), an oil filter (36) and a heat exchanger (37).

7. The seal joint according to claim 6, wherein the seal joint comprises a rigid tube (51) the length of which is sufficient to be arranged over a damaged part (50) of a used propeller shaft of an older boat, said rigid tube length being fitted and kept concentrical with the propeller shaft by bushes (52, 53) in which third elastic rings (O-rings 54, 56) are provided to prevent water leakage.

8. The seal joint according to claim 5, wherein the seal joint comprises a rigid tube (51) the length of which is sufficient to be arranged over a damaged part (50) of a used propeller shaft of an older boat, said rigid tube length being fitted and kept concentrical with the propeller shaft by bushes (52, 53) in which third elastic rings (O-rings 54, 56) are provided to prevent water leakage.

9. The seal joint according to claim 2 wherein upstream of casing (9) said seal joint includes a safety electric switch (25) and a control arm (26) arranged between two second elastic rings (27, 28) fitted onto said propeller shaft (2) for electric switch actuation upon an excessive sliding of the propeller shaft.

10. The seal joint according to claim 2, wherein the seal joint comprises a rigid tube (51) the length of which is sufficient to be arranged over a damaged part (50) of a used propeller shaft of an older boat, said rigid tube length being fitted and kept concentrical with the propeller shaft by bushes (52, 53) in which third elastic rings (O-rings 54, 56) are provided to prevent water leakage.

11. The seal joint according to claim 1 wherein upstream of casing (9) said seal joint includes a safety electric switch (25) and a control arm (26) arranged between two second elastic rings (27, 28) fitted onto said propeller shaft (2) for electric switch actuation upon an excessive sliding of the propeller shaft.

12. The seal joint according to claim 11, wherein the seal joint comprises a rigid tube (51) the length of which is sufficient to be arranged over a damaged part (50) of a used propeller shaft of an older boat, said rigid tube length being fitted and kept concentrical with the propeller shaft by bushes (52, 53) in which third elastic rings (O-rings 54, 56) are provided to prevent water leakage.

13. The seal joint according to claim 2, wherein said second chamber (32, 34, 35) is contained between the first elastic rings (10, 14) and communicates through a hole (12) within the support bushing (11) with a ring-shaped channel (30) surrounding the propeller shaft (2) to lubricate the propeller shaft, said support bushing (11) and two retention rings (18, 33) for rotating shafts wherein said retention rings have elastic asymmetric lips.

14. The seal joint according to claim 13, wherein the seal joint comprises a reservoir (24) for the lubricating oil (23), said reservoir (24) being located at a greater height than the water level of the boat hull so as to fill with oil said second chamber (32, 34, 35) through supply pipes (31*b*) that are fixed by grooved nipples (13*b*) to a cylindrical casing (9) and through the ring-shaped channel (30), a grooved nipple (13) communicating with said crown-shaped chamber (35) being provided for the outlet of oil (23) back to the reservoir (24) through a return pipe (31).

15. The seal joint according to claim 13, wherein the seal joint comprises a rigid tube (51) the length of which is sufficient to be arranged over a damaged part (50) of a used propeller shaft of an older boat, said rigid tube length being fitted and kept concentrical with the propeller shaft by bushes (52, 53) in which third elastic rings (O-rings 54, 56) are provided to prevent water leakage.

16. The seal joint according to claim 1, wherein the seal joint comprises a rigid tube (51) the length of which is sufficent to be arranged over a damaged part (50) of a used propeller shaft of an older boat, said rigid tube length being fitted and kept concentrical with the propeller shaft by bushes (52, 53) in which third elastic rings (O-rings 54, 56) are provided to prevent water leakage.

* * * * *